United States Patent [19]

Rothenberger

[11] 4,178,786

[45] Dec. 18, 1979

[54] NECKING-OUT TOOL FOR FORMING NECKS ON PIPES

[75] Inventor: Karl Rothenberger, Walldorf,Hessen, Fed. Rep. of Germany

[73] Assignee: Rothenberger GmbH & Co., Frankfurt, Fed. Rep. of Germany

[21] Appl. No.: 666,118

[22] Filed: Mar. 11, 1976

[30] Foreign Application Priority Data

Mar. 15, 1975 [DE] Fed. Rep. of Germany ..... 2511491

[51] Int. Cl.[2] ..... B21D 51/40

[52] U.S. Cl. ..... 72/117; 72/125; 72/316; 29/157 T

[58] Field of Search ..... 72/112, 117, 125, 316; 29/157 T; 81/421, 422, 423, 424

[56] References Cited

U.S. PATENT DOCUMENTS

| | | | |
|---|---|---|---|
| 2,725,774 | 12/1955 | Tekse | 81/423 |
| 3,050,102 | 8/1962 | Hock | 72/117 |

FOREIGN PATENT DOCUMENTS

| | | | |
|---|---|---|---|
| 2413291 | 10/1975 | Fed. Rep. of Germany | 29/157 T |

*Primary Examiner*—Lowell A. Larson

*Attorney, Agent, or Firm*—Sprung, Felfe, Horn, Lynch & Kramer

[57] ABSTRACT

A necking-out tool for forming cylindrical nipples or necks on the circumferential surface of pipelines, containers and the like. The tool is provided with a screw plug having a hook-shaped forming head and a thrust sleeve fitted with a coaxial downholder flange cooperating with the forming head and the screw plug. The thrust sleeve has a hollow cylindrical interior corresponding to the forming head for the reception of the formed neck. A holding appliance resembling tongs is connected to the downholder flange and the thrust sleeve by a hinge. The holding appliance is adapted to be applied at right angles or from the side of the pipeline. One jaw of the tongs terminates at the hinge and the other jaw forms a trough-shaped support for the pipeline on the side opposite the hinge.

8 Claims, 4 Drawing Figures

FIG. 1
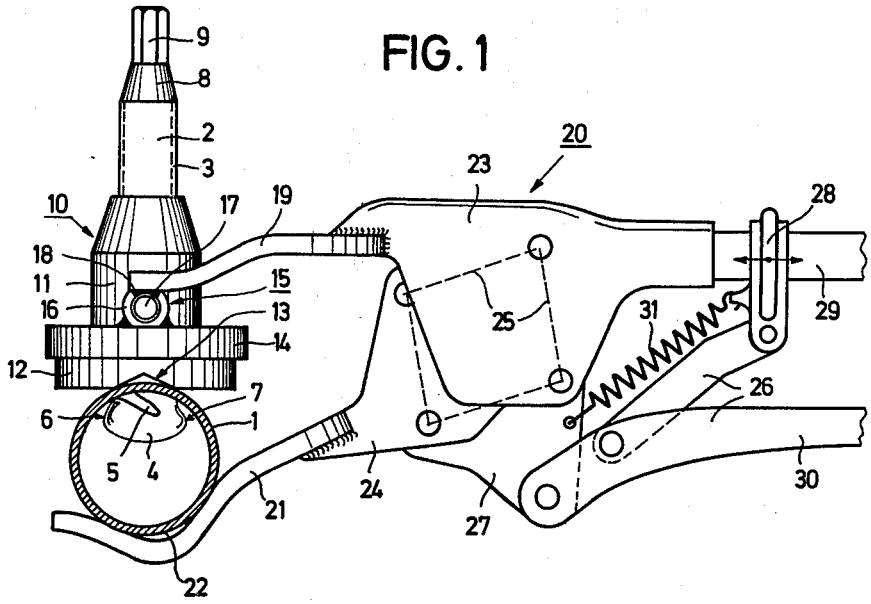
FIG. 3
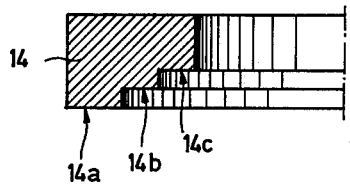
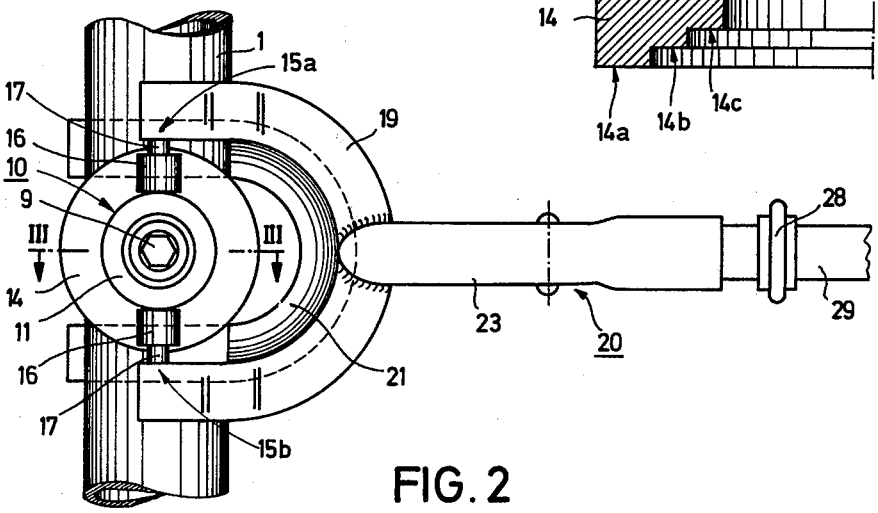
FIG. 2

NECKING-OUT TOOL FOR FORMING NECKS ON PIPES

BACKGROUND

This invention relates to a necking-out tool for forming cylindrical nipples ("necks") on the circumferential surface of pipelines, containers and the like. The tool includes a screw plug having a hook-shaped forming head and a thrust sleeve fitted with a coaxial downholder cooperating with the forming head and the screw plug, and having a hollow cylindrical interior corresponding to the forming head for the reception of the formed neck.

When such a tool is used, a hole is first drilled into the cylindrical hollow body that is to be provided with the nipple ("neck"), the diameter of the hole just permitting the forming head of the tool to be passed through. For this purpose, the forming head is turned far enough out of the thrust sleeve to enable it to be manipulated through the hole by taking advantage of an oblique slot cut into the head. The tool is then reerected into a radical position in relation to the pipe axis and the forming head is retracted into the thrust sleeve by rotating the screw plug. This operation causes the material of the hollow body to be plastically deformed into the shape of a projecting edge having an external diameter corresponding to the internal diameter of the thrust sleeve. During this forming process, the thrust sleeve bears on the hollow body which takes up the reactive force. A tool of this type and the manner in which it functions is described in German Patent No. 7 311 408.

This prior art tool is generally used by simply mounting it on the hollow body that is to be deformed and by then bringing about the desired forming operation by rotating the screw plug. The hollow body is not gripped or embraced by an accessory appliance. During manipulation of the prior art tool, it occasionally happens that during the final phase of the forming operation the forming head pulls out of the hollow body so that the necking-out operation cannot be completed and the pipe which is to be joined to the hollow body will not then fit the nipple, respectively neck.

The sudden release of the forming head is also a considerable accident hazard, particularly when the fitter is in a position in which he has restricted freedom of movement. The thrust sleeve must be tightly held by hand during the entire operation and this may also be very difficult in an inaccesible place, since a fairly considerably physical effort is needed, which may be beyond the strength of some men. The necking-out operation may then take some time to perform.

It has been proposed in U.S. Pat. No. 3,131,746 to design a necking-out tool in the form of a massive body which can be hingeably opened and placed and screwed around the pipeline on which a neck is to be formed. A heavy body of such a kind is needed principally because the forming head is not symmetrical and therefore subjected to a one-sided load. It is often impossible to attach this massive body to pipelines that are already installed. Its major drawback is that it is suitable for application to pipes of only one particular diameter. A plumber who wishes to form necks on pipes of different diameters would thus be obliged to carry a corresponding number of tools of this kind in his kit. However, in view of their weight this would be a practical impossibility. Consequently, this prior art tool is primarily intended for use inside the factory and is not practical for a small plumber's business or for use on building sites.

SUMMARY

The present invention provides an improved necking-out tool that can be rapidly and easily attached to pipelines of different diameters without any significant increase in the weight of the equipment a plumber must carry in his kit.

The necking-out tool of the invention is provided with a holding appliance resembling tongs connected to the downholder flange and the thrust sleeve by a hinge and adapted to be applied to the pipeline from the side, one jaw of the tongs terminating at the hinge and the other jaw forming a trough-shaped support for the pipeline on the side diametrically opposite the hinge.

DESCRIPTION OF THE DRAWING

FIG. 1 is a side elevational view of a necking-out tool mounted on a pipe immediately before the necking-out operation takes place;

FIG. 2 is a top view of the tool shown in FIG. 1;

FIG. 3 is a partial sectional view of the retaining ring taken along line III—III of FIG. 2.

DESCRIPTION

Figure 4:
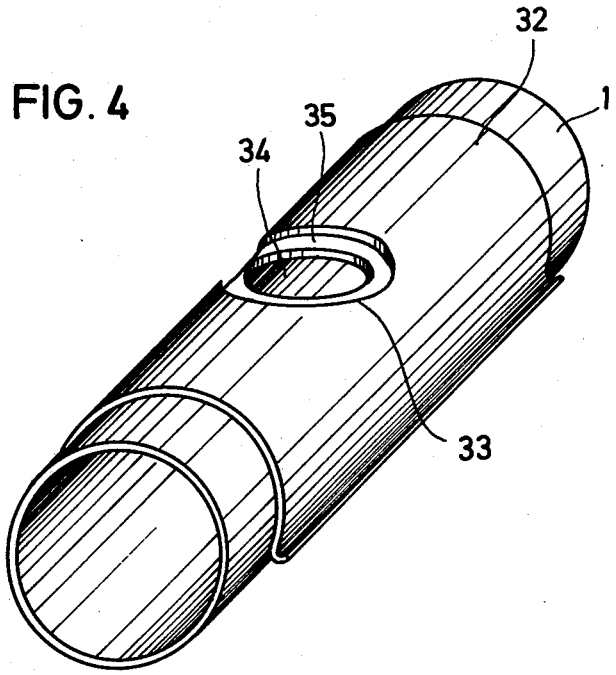
FIG. 4 is a perspective view of a pipe provided with a sheet steel protector.

The hinged connection between the thrust sleeve and the holding appliance permits the thrust sleeve and the forming head to be radially precisely aligned with the support for the pipeline on the diametrically opposite side. This radial alignment can be maintained within a wide range of pipe diameters for which the holding appliance is designed. The plumber or fitter therefore needs to carry only one holding appliance for a wide range of pipe diameters. The appliance can be quickly and reliably fitted from the side to a pipeline that is already installed, the hinge permitting the slotted forming head to be conveniently inserted into the pre-drilled hole in the pipe. The holding appliance ensures that the necking-out tool will be reliably located during the entire process so that a sudden pull-out of the forming head is safely prevented. Consequently, there is no hazard for a man working in a restricted position. The necking-out process can be reliably completed and subsequent difficulties in inserting the desired branch pipe cannot occur. The thrust sleeve need not be manually held. The effort required on the part of the fitter is substantially less and one hand remains free for instance for holding himself in an awkward position. The working pseed will also be higher, particularly if a rachet wrench is used for turning the screw plug.

It is preferred that the second jaw of the tongs, which forms the backing support for the pipeline be made of thin sheet steel, sectioned to give it strength, and provided with a V-shaped bend so that the open side of the V faces the hinge. This configuration enables this jaw to be inserted behind pipes that have been installed very close to a wall or other part of a building.

It is preferable not to attach the hinge directly to the downholder flange of the thrust sleeve, but to a separate retaining ring in which the thrust sleeve is exchangeably held. Thrust sleeves and forming heads for different neck diameters can thus be selectively fitted into the holding appliance. In such a case, the holding appliance will enable not only pipes of different diameters to be provided with necks, but these pipes to be provided with necks of different diameters. This is likewise impossible to do with tools hitherto known in the art. It is particularly desirable to provide the retaining ring with several stepped internal abutment shoulders to permit thrust sleeves of different sizes to be fitted.

A particularly simple design according to the invention is one in which the jaw of the tongs terminating at the hinge is a symmetrically bifurcated fork to embrace the thrust sleeve, one-half of the hinge being provided at the end of each arm of the fork in such manner that the axis of the hinge in use is parallel to the axis of the pipeline and crosses the axis of the thrust sleeve.

Naturally, it is possible to provide the tong-like holding appliance with means that permit the jaws to be tightened, such as a tightening screw. However, a particularly simple arrangement consists in making the holding appliance self-locking, as is the case for instance with the type of mechanism used for 'gripper tongs'. In such a case, the holding appliance containing the thrust sleeve and forming head can be easily pushed over the pipeline, the jaws pressed together, and the necking-out tool retained firmly in the required position.

The holding appliance applies additional pressure to the pipe, which adds to the reactive force applied by the thrust sleeve during the necking-out process. In order to prevent the pipe from buckling where the downholder flange of the thrust sleeve bears on the pipe, an accessory device can be provided in the form of an interposed member consisting of spring steel sheet between the downholder flange and the pipeline which is to be provided with a neck, the length of said interposed member being at least equal to the diameter of the downholder flange of the thrust sleeve, and the member being provided with a hole of a diameter which is sufficiently large to permit the material which is deformed during the creation of the neck to enter the thrust sleeve without being impeded.

An embodiment of the invention, the manner in which it functions and the associated accessory appliance will now be more particularly described with reference to FIGS. 1–4 of the drawing.

Referring to FIG. 1, it is proposed to form a cylinddrical neck on the side of a pipe 1 with the aid of the necking-out tool which will be hereinafter described in greater detail. The neck is required to permit a branch pipe or the like to be fitted or soldered to the main pipe 1. The necking-out tool as such comprises a screw plug 2 which is provided with a fine thread 3 and at one end carries a hookshaped forming head 4. The latter springs from a substantially conical extension of the screw plug 2 and in a plane across the pipe axis its cross section is roughly oblong, the width of the oblong being slightly shorter than the diameter of the completed cylindrical neck. In order to permit this head to be passed through a hole drilled into the wall of the pipe, the forming head is provided with an obliquely cut slot 5. The faces which actually function to form the neck are indicated in the drawing at 6 and 7. Their transitions into the other surfaces of the forming head are well rounded to ensure a smooth sliding movement on the deforming material. It will be understood from the drawing that the reactive force acts symmetrically on the faces 6 and 7 of the forming head and that no one-sided loads are generated. The screw plug is provided at the opposite end with a cone 8 which adjoins a hexagonal end 9 for the application thereto of a lever, such as a rachet spanner.

The screw plug 2 works in a thrust sleeve 10 which comprises a hollow cylindrical portion 11 and a wider ring-shaped downholder flange 12. The hollow cylindrical portion 11 contains an internal cylindrical bore (not shown) of a diameter and length corresponding to the dimension of the neck it is desired to form. The thrust sleeve 10 contains an internal thread for cooperation with the external thread 3. The downholder flange 12 is formed on diametrically opposite sides with recesses 13 which extend across the width of the face 7 of the flange. These recesses are inverted 'V's having sides including an angle of 120°.

The thrust sleeve 10 is inserted into a retaining ring 14 which bears on the flange 12. The side of the retaining ring 14 remote from the downholder flange 12 carries a hinge 15 comprising a pivot bearing 16, a pin 17 and a further pivot bearing 18. The pivot bearing 16 is attached to the retaining ring, whereas the other pivot bearing 18 is attached to one jaw 19 of a gripper-like holding appliance 20 which is the subject matter of the invention. The holding appliance 20 comprises a second jaw 21 which forms a socket 22 for the reception of the pipe 1 on the side diametrically opposite that where the hinge 15 is situated. The thrust sleeve 10 is exchangeably located inside the retaining ring 14.

The holding appliance 20 is a self-locking device and in the present embodiment it contains the conventional mechanism of a 'gripping tong'. One jaw 19 is affixed to a body 23 in which a holder 24 is pivotably attached to a parallel four-bar linkage 25 which is shown schematically in the drawing. The other jaw 21 is attached to this holder 24. The holding appliance 22 is opened and closed by a toggle lver device 26 which transmits the forces to the holder 24 through a link 27. The holding appliance is pre-adjusted by a manually displaceable slider 28 which is longitudinally shiftable on one handle 29 of the tongs, and which locks itself in pre-adjusted position. The other handle 30 is constituted by an extension of the toggle lever device 26. A spring 31 causes the jaws 19 and 21 to close when the slider 28 is released.

It will be understood from FIG. 1 that the entire holding appliance 20 is of very light weight and of simple design which can be readily inserted underneath the pipe 1 without requiring significant space. In the illustrated position the pipe 1 can be worked upon lying on the ground, the screw plug 2 being turned by a ratchet wrench and the counterforce being applied by the handles 29 and 30 of the tongs.

In FIG. 2, the same parts as those shown in FIG. 1 are identified by the same reference numbers. The jaw 19 which terminates at the hinge 15 is symmetrically bifurcated, embracing the thrust sleeve 10 and being provided on the end of each arm with one-half 15*a* and 15*b* of the hinge bearing, the hinge bearing, the hinge axis being parallel to the pipe 1 and crossing the relatively perpendicular axis of the thrust sleeve 10. The other jaw 21 in the illustrated example is likewise symmetrical and bifurcated although it would naturally also be feasible to provide an undivided centrally disposed jaw 21.

FIG. 3 is a part sectional representation of the retaining ring 14 on a larger scale. Apart from its bottom face 14*a* for supporting the downholder flange 12 of a thrust sleeve 10 of maximum size, it contains two further reduced diameter abutment faces 14*b* and 14*c* for smaller thrust sleeve 10. Moreover, the hinge 15 need not be fitted to the top of the retaining ring as shown in FIG.

1; instead, the hinge pin 17 can be mounted in the body of the retaining ring 14 itself.

FIG. 4 shows a spring hard sheet steel member which is interposed between the downholder flange 12 and the pipe 1. This interposed member embraces the pipe 1 like a clip, i.e., it surrounds a little more than half the circumference of the pipe 1. The length of the interposed member 32 is at least equal to the diameter of the downholder flange 12 of the thrust sleeve 10. It is provided with a hole 33 having a diameter which is sufficiently large to permit the deforming material during the formation of the neck to enter the thrust sleeve without being impeded. The hole 34 in the pipe 1 is also visible in FIG. 4. Naturally, this hole is somewhat smaller than the hole 33 in the interposed member. Part 35 of the pipe which is here visible is substantially that part which is deformed to provide the 'neck'. The interposed member 32 reliably prevents the pipe 1 from being buckled by the pressure of the downholder flange 12.

What is claimed is:

1. A necking-out tool for forming cylindrical nipples on the circumferential surface of pipelines, containers and the like having screw plug means with hook-shaped forming head means and thrust sleeve means fitted with coaxial downholder flange means cooperating with the forming head means and the screw plug means; said thrust sleeve means having a hollow cylindrical interior having a central longitudinal axis and corresponding to the forming head means for the reception of the formed neck, the improvement which comprises holding means comprising two pivotally connected jaws and means pivotally connecting one jaw to the downholder flange means and the thrust sleeve means such that they pivot parallel to the pivoting of the jaws and comprising a hinge pin disposed perpendicular to the longitudinal axis and at least adjacent thereto at the terminal end of said one jaw and wherein the other jaw forming a trough-shaped support diametrically opposite the hinge.

2. Necking-out tool of claim 1 wherein the hinge is connected to retaining ring means which replaceably contains the thrust sleeve means.

3. Necking-out tool of claim 2 wherein the retaining ring means contains several progressively stepped internal shoulders to serve as abutments for thrust sleeve means of different sizes.

4. Necking-out tool of claim 1 wherein said one jaw comprises a symmetrically bifurcated fork embracing the thrust sleeve means, one-half of the hinge being at the end of each arm of the fork in such manner that the axis of the hinge means in use is parallel to the axis of the pipeline and crosses the longitudinal axis of the thrust sleeve means.

5. Necking-out tool of claim 1 wherein the trough-shaped support is a V-shaped knee-bend in the other jaw, the open side of the V facing the hinge.

6. Necking-out tool of claim 1 wherein the holding means comprises self-locking means.

7. Necking-out tool of claim 6 wherein the holding means comprises a gripper type mechanism.

8. Necking-out tool of claim 1 wherein means consisting of spring steel sheet is interposed between the downholder flange means and the pipeline which is to be provided with a neck, the length of said interposed means being at least equal to the diameter of the downholder flange means of the thrust sleeve means, said interposed means being provided with a hole of a diameter which is sufficiently large to permit the material which is deformed during the creation of the neck to enter the thrust sleeve means without being impeded.

* * * * *